US010139157B2

(12) United States Patent
Currence

(10) Patent No.: US 10,139,157 B2
(45) Date of Patent: Nov. 27, 2018

(54) NGL RECOVERY FROM NATURAL GAS USING A MIXED REFRIGERANT

(75) Inventor: Kevin L. Currence, Olathe, KS (US)

(73) Assignee: BLACK & VEATCH HOLDING COMPANY, Overland Park, KS (US)

( * ) Notice: Subject to any disclaimer, the term of this patent is extended or adjusted under 35 U.S.C. 154(b) by 203 days.

(21) Appl. No.: 13/402,349

(22) Filed: Feb. 22, 2012

(65) Prior Publication Data

US 2013/0213087 A1 Aug. 22, 2013

(51) Int. Cl.
*F25J 3/02* (2006.01)

(52) U.S. Cl.
CPC ..... *F25J 3/0209* (2013.01); *F25J 3/0233* (2013.01); *F25J 3/0238* (2013.01); *F25J 2200/02* (2013.01); *F25J 2200/70* (2013.01); *F25J 2205/04* (2013.01); *F25J 2210/06* (2013.01); *F25J 2270/12* (2013.01); *F25J 2270/66* (2013.01)

(58) Field of Classification Search
CPC ..... F25J 3/0209; F25J 3/0238; F25J 2270/66; F25J 2205/04; F25J 2200/02; F25J 3/0233; F25J 2200/70; F25J 2270/12; F25J 221/06
USPC ..... 62/612, 614, 618, 620, 621, 623
See application file for complete search history.

(56) References Cited

U.S. PATENT DOCUMENTS

| | | | |
|---|---|---|---|
| 2,976,695 | A | 10/1961 | Meade |
| 3,191,395 | A | 6/1965 | Maher et al. |
| 3,210,953 | A | 10/1965 | Reed |
| 3,271,967 | A | 9/1966 | Karbosky |
| 3,596,472 | A | 8/1971 | Streich |
| 3,729,944 | A | 5/1973 | Kelley et al. |
| 3,800,550 | A | 4/1974 | Delahunty |
| 3,932,154 | A | 1/1976 | Coers et al. |
| 4,033,735 | A | 7/1977 | Swenson |
| 4,036,028 | A | 7/1977 | Mandrin |
| 4,217,759 | A | 8/1980 | Shenoy |

(Continued)

FOREIGN PATENT DOCUMENTS

| | | |
|---|---|---|
| JP | 200018049 | 1/2000 |
| JP | 20025398 | 1/2002 |
| JP | 2003232226 | 8/2003 |
| WO | 2005045338 | 5/2005 |

OTHER PUBLICATIONS

Gas Processors Suppliers Association, Engineering Data Book, Section 16, "Hydrocarbon Recovery," p. 16-1 through 16-33,12th ed. (2004).*

(Continued)

*Primary Examiner* — Frantz Jules
*Assistant Examiner* — Webeshet Mengesha
(74) *Attorney, Agent, or Firm* — Hovey Williams LLP

(57) ABSTRACT

An NGL recovery facility for separating ethane and heavier ($C_2$+) components from a hydrocarbon-containing feed gas stream that utilizes a single, closed-loop mixed refrigerant cycle. The vapor and liquid portions of the feed gas stream are isenthalpically flashed and the resulting expanded streams are introduced into the NGL recovery column. Optionally, a second vapor stream can be flashed and then introduced into the recovery column at the same or lower separation stage than the flashed liquid stream. As a result, the NGL recovery facility can optimize $C_2$+ recovery with compression costs.

18 Claims, 1 Drawing Sheet

(56) References Cited

U.S. PATENT DOCUMENTS 4,249,387 A 2/1981 Crowley
4,311,496 A 1/1982 Fabian
4,411,677 A * 10/1983 Pervier et al. ..... 62/622
4,525,187 A 6/1985 Woodward et al.
4,584,006 A * 4/1986 Apffel ..... C07C 7/04 62/628
4,662,919 A * 5/1987 Davis ..... 62/622
4,676,812 A 6/1987 Kummann
4,707,170 A * 11/1987 Ayres et al. ..... 62/627
4,714,487 A 12/1987 Rowles
4,720,294 A 1/1988 Lucadamo et al.
4,727,723 A 3/1988 Durr
4,854,955 A * 8/1989 Campbell et al. ..... 62/621
4,869,740 A 9/1989 Campbell et al.
4,878,932 A 11/1989 Phade et al.
5,051,120 A 9/1991 Pahade et al.
5,148,680 A 9/1992 Dray
5,182,920 A 2/1993 Matsuoka et al.
5,275,005 A 1/1994 Campbell et al.
5,351,491 A 10/1994 Fabian
5,377,490 A 1/1995 Howard et al.
5,379,597 A 1/1995 Howard et al.
5,398,497 A 3/1995 Suppes
5,497,626 A 3/1996 Howard et al.
5,502,972 A 4/1996 Howard et al.
5,555,748 A 9/1996 Campbell et al.
5,566,554 A 10/1996 Vijayaraghavan et al.
5,568,737 A 10/1996 Campbell et al.
5,596,883 A 1/1997 Bernhard et al.
5,615,561 A 4/1997 Houshmand et al.
5,657,643 A * 8/1997 Price ..... 62/612
5,771,712 A 6/1998 Campbell et al.
5,791,160 A 8/1998 Mandler et al.
5,799,507 A 9/1998 Wilkinson et al.
5,881,569 A * 3/1999 Campbell et al. ..... 62/621
5,890,377 A 4/1999 Foglietta
5,890,378 A 4/1999 Rambo et al.
5,950,453 A 9/1999 Bowen et al.
5,979,177 A 11/1999 Sumner et al.
5,983,664 A 11/1999 Campbell et al.
5,983,665 A 11/1999 Howard et al.
5,992,175 A 11/1999 Yao et al.
6,003,603 A 12/1999 Breivik et al.
6,021,647 A 2/2000 Ameringer et al.
6,023,942 A 2/2000 Thomas et al.
6,035,651 A 3/2000 Carey
6,053,008 A 4/2000 Arman et al.
6,070,430 A 6/2000 McNeil et al.
6,085,546 A 7/2000 Johnston
6,105,390 A 8/2000 Bingham et al.
6,112,550 A 9/2000 Bonaquist et al.
6,182,469 B1 2/2001 Campbell et al.
6,260,380 B1 7/2001 Arman et al.
6,266,977 B1 7/2001 Howard et al.
6,295,833 B1 10/2001 Hoffart et al.
6,311,516 B1 11/2001 Key et al.
6,311,519 B1 11/2001 Gourbier et al.
6,330,811 B1 12/2001 Arman et al.
6,363,728 B1 4/2002 Udischas et al.
6,367,286 B1 * 4/2002 Price ..... 62/613
6,401,486 B1 6/2002 Lee et al.
6,405,561 B1 6/2002 Mortko et al.
6,412,302 B1 7/2002 Foglietta
6,425,263 B1 7/2002 Bingham et al.
6,425,266 B1 * 7/2002 Roberts ..... 62/621
6,427,483 B1 8/2002 Rashad et al.
6,438,994 B1 8/2002 Rashad et al.
6,449,982 B1 9/2002 Fischer
6,449,983 B2 9/2002 Pozivil
6,460,350 B2 10/2002 Johnson et al.
6,560,989 B1 5/2003 Roberts et al.
6,578,379 B2 6/2003 Paradowski
6,581,410 B1 6/2003 Johnson et al.
6,662,589 B1 12/2003 Roberts et al.
6,725,688 B2 4/2004 Elion et al.
6,745,576 B1 6/2004 Granger
6,823,691 B2 11/2004 Ohta
6,823,692 B1 11/2004 Patel et al.
6,915,662 B2 7/2005 Wilkinson et al.
6,925,837 B2 8/2005 Eaton
6,945,075 B2 9/2005 Wilkinson et al.
7,051,553 B2 5/2006 Mak et al.
7,069,744 B2 7/2006 Patel et al.
7,100,399 B2 9/2006 Eaton
7,107,788 B2 9/2006 Patel et al.
7,114,342 B2 10/2006 Oldham et al.
7,152,428 B2 12/2006 Lee et al.
7,152,429 B2 * 12/2006 Paradowski ..... 62/620
7,159,417 B2 1/2007 Foglietta et al.
7,191,617 B2 3/2007 Cuellar et al.
7,204,100 B2 4/2007 Wilkinson et al.
7,210,311 B2 5/2007 Wilkinson et al.
7,216,507 B2 5/2007 Cuellar et al.
7,219,513 B1 5/2007 Mostafa
7,234,321 B2 6/2007 Maunder et al.
7,234,322 B2 6/2007 Hahn et al.
7,266,975 B2 9/2007 Lin et al.
7,310,972 B2 12/2007 Yoshida et al.
7,316,127 B2 1/2008 Huebel et al.
7,357,003 B2 4/2008 Ohara et al.
7,484,385 B2 2/2009 Patel et al.
7,614,241 B2 11/2009 Mostello
7,644,676 B2 1/2010 Lee et al.
7,713,497 B2 5/2010 Mak
7,793,517 B2 9/2010 Patel et al.
7,818,979 B2 10/2010 Patel et al.
7,841,288 B2 11/2010 Lee et al.
7,856,847 B2 12/2010 Patel et al.
8,505,312 B2 8/2013 Mak et al.
8,549,876 B2 10/2013 Kaart et al.
8,650,906 B2 2/2014 Price et al.
8,671,699 B2 3/2014 Rosetta et al.
2002/0095062 A1 * 7/2002 Paradowski ..... F25J 3/0209 585/802
2002/0166336 A1 11/2002 Wilkinson et al.
2003/0029190 A1 2/2003 Trebble
2003/0046953 A1 3/2003 Elion et al.
2004/0159122 A1 8/2004 Patel et al.
2005/0056051 A1 3/2005 Roberts et al.
2005/0204625 A1 9/2005 Briscoe et al.
2006/0150672 A1 * 7/2006 Lee ..... F25J 3/0209 62/623
2006/0260355 A1 11/2006 Roberts et al.
2006/0260358 A1 11/2006 Kun
2007/0157663 A1 * 7/2007 Mak et al. ..... 62/620
2007/0231244 A1 10/2007 Shah et al.
2008/0264076 A1 10/2008 Price et al.
2009/0193846 A1 8/2009 Foral et al.
2009/0205367 A1 8/2009 Price
2009/0217701 A1 9/2009 Minta et al.
2010/0043488 A1 2/2010 Mak et al.
2010/0064725 A1 * 3/2010 Chieng et al. ..... 62/620
2010/0132405 A1 6/2010 Nilsen
2011/0174017 A1 * 7/2011 Victory ..... F25J 3/0209 62/620
2011/0289963 A1 12/2011 Price
2012/0000245 A1 1/2012 Currence et al.
2012/0090324 A1 4/2012 Rosetta et al.
2012/0137726 A1 6/2012 Currence et al.
2013/0213807 A1 8/2013 Hanko et al.

OTHER PUBLICATIONS

Gas Processors Suppliers Association (GPSA) Engineering Databook, Section 16, "Hydrocarbon Recovery," p. 16-13 through 16-20, 12th ed. (2004).

* cited by examiner

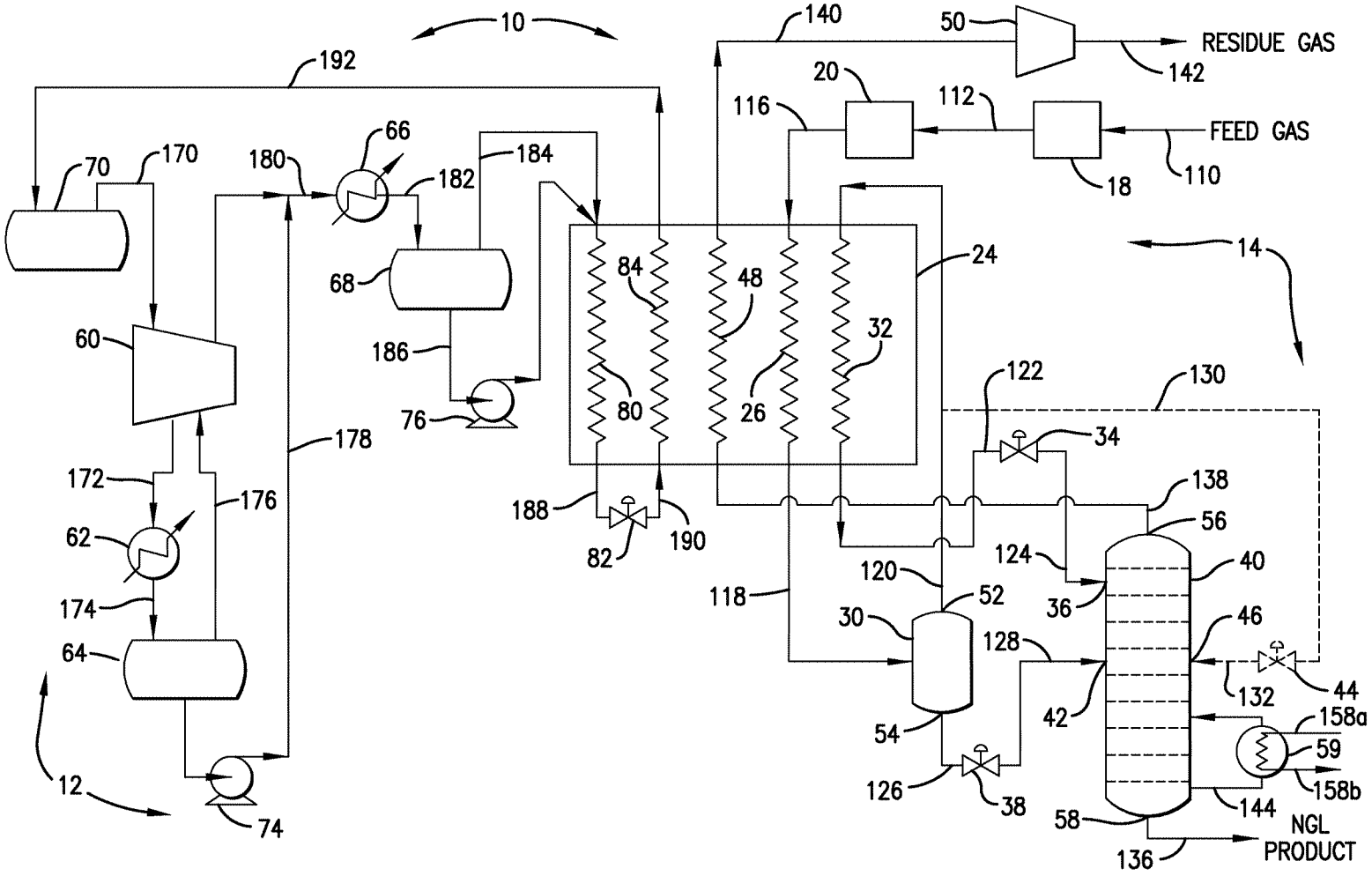
RESIDUE GAS
FEED GAS
NGL PRODUCT
142
110
18
14
130
138
56
40
46
44
158a
59
158b
132
144
136
58
42
36
124
128
38
126
34
122
52
54
30
120
118
50
112
24
32
20
140
116
48
26
190
84
80
82
188
184
182
66
68
186
76
10
192
178
180
176
74
170
70
60
172
62
174
64
12

NGL RECOVERY FROM NATURAL GAS USING A MIXED REFRIGERANT

BACKGROUND

1. Technical Field

One or more embodiments of the present invention generally relate to systems and processes for recovering natural gas liquids (NGL) from a hydrocarbon-containing gas stream using a single closed-loop mixed refrigerant cycle.

2. Description of Related Art

Ethane and heavier ($C_2$+) components recovered from a hydrocarbon gas stream can be utilized for a variety of purposes. For example, upon further processing, the recovered $C_2$+ materials may be employed as fuel and/or as feedstock for a variety of petroleum and/or petrochemical processes. The primary challenge in $C_2$+ recovery processes has traditionally been the ability to balance high product recovery with the costs of the compression. In particular, the achievement of a high (80+ percent) $C_2$+ recovery has typically required a correspondingly high level of feed gas, residue gas, and/or refrigerant compression, which, consequently, increases both capital and operating expenses.

Thus, a need exists for processes and systems for recovering ethane and heavier components from a hydrocarbon-containing feed gas stream that optimize compression requirements with recovery of valuable products. The system should be both robust and operationally flexible in order to handle variations in feed gas composition and flow rate. At the same time, the system should also be simple and cost-efficient to operate and maintain.

SUMMARY

One embodiment of the present invention concerns a process for recovering natural gas liquids (NGL) from a hydrocarbon-containing feed gas stream. The process comprises: (a) cooling and at least partially condensing a hydrocarbon-containing feed gas stream to thereby provide a cooled feed gas stream, wherein at least a portion of the cooling is carried out via indirect heat exchange with a mixed refrigerant stream in a closed-loop refrigeration cycle; (b) separating the cooled feed gas stream into a first vapor stream and a first liquid stream in a vapor-liquid separator; (c) cooling at least a portion of the first vapor stream to thereby provide a cooled vapor stream; (d) flashing the cooled vapor stream to thereby provide a first flashed stream; (e) introducing the first flashed stream and the first liquid stream into a distillation column via respective first and second fluid inlets of the distillation column; and (f) recovering an overhead residue gas stream and a liquid bottoms product stream from the distillation column, wherein the liquid bottoms product stream is enriched in NGL components.

Another embodiment of the present invention concerns a process for recovering natural gas liquids (NGL) from a hydrocarbon-containing feed gas stream. The process comprises: (a) cooling a hydrocarbon-containing feed gas stream to thereby provide a cooled feed gas stream; (b) separating the cooled feed gas stream into a first vapor stream and a first liquid stream in a vapor-liquid separator; (c) splitting the first vapor stream into a first vapor portion and a second vapor portion; (d) cooling the first vapor portion to thereby provide a cooled vapor portion, wherein at least a portion of the cooling is carried out via indirect heat exchange with a mixed refrigerant stream in a closed-loop refrigeration cycle; (e) flashing the cooled vapor portion to thereby provide a first flashed stream; (f) flashing the second vapor portion to thereby provide a second flashed stream; (g) introducing the first and the second flashed streams into a distillation column at respective first and second fluid inlets; and (h) recovering an NGL-enriched liquid product stream from the distillation column, wherein the second fluid inlet is located at a lower separation stage than the first fluid inlet.

Yet another embodiment of the present invention concerns a facility for recovering natural gas liquids (NGL) from a hydrocarbon-containing feed gas stream using a single closed-loop mixed refrigeration cycle. The facility comprises a primary heat exchanger having a first cooling pass and a second cooling pass disposed therein, a vapor-liquid separator, a second cooling pass, a first expansion device, a second expansion device, a distillation column, and a single closed-loop mixed refrigerant cycle. The first cooling pass is operable to cool the hydrocarbon-containing feed gas stream and the vapor-liquid separator is fluidly coupled to the first cooling pass for receiving the cooled feed gas stream. The vapor-liquid separator comprises a first vapor outlet for discharging a first vapor stream and a first liquid outlet for discharging a first liquid stream. The second cooling pass is fluidly coupled to the first vapor outlet of the vapor-liquid separator for cooling at least a portion of the first vapor stream. The first expansion device is fluidly coupled to the second cooling pass for flashing at least a portion of the cooled vapor stream, and the second expansion device is fluidly coupled to the first liquid outlet of the vapor-liquid separator for flashing the first liquid stream. The distillation column comprises a first fluid inlet for receiving a first flashed stream from the first expansion device and a second fluid inlet for receiving a second flashed stream from the second expansion device, wherein the first fluid inlet of the distillation column is positioned at a higher separation stage than the second fluid inlet of the distillation column.

The single closed-loop mixed refrigeration cycle comprises a refrigerant compressor, a first refrigerant cooling pass, a refrigerant expansion device, and a first refrigerant warming pass. The refrigerant compressor defines a suction inlet for receiving a mixed refrigerant stream and a discharge outlet for discharging a stream of compressed mixed refrigerant. The first refrigerant cooling pass is fluidly coupled to the discharge outlet of the refrigerant compressor for subcooling the compressed mixed refrigerant stream and the refrigerant expansion device is fluidly coupled to the first refrigerant cooling pass for expanding the subcooled mixed refrigerant stream and generating refrigeration. The first refrigerant warming pass is fluidly coupled to the refrigerant expansion device for warming the expanded mixed refrigerant stream via indirect heat exchange with at least one of the compressed mixed refrigerant in the first refrigerant cooling pass, the feed gas stream in the first cooling pass, and the vapor stream in the second cooling pass and the first refrigerant warming pass is fluidly coupled to the suction inlet of the refrigerant compressor.

BRIEF DESCRIPTION OF THE DRAWINGS

Various embodiments of the present invention are described in detail below with reference to the attached FIGURE, wherein:

FIG. 1 provides a schematic depiction of a natural gas liquids (NGL) recovery facility configured according to one embodiment of the present invention, particularly illustrating the use of a single closed-loop mixed refrigerant system to recover ethane and heavier components from a feed gas stream.

DETAILED DESCRIPTION

Turning now to FIG. 1, a schematic depiction of a natural gas liquids (NGL) recovery facility 10 configured according to one or more embodiments of the present invention is provided. As used herein, the terms "natural gas liquids" or "NGL" refer to a fluid mixture of one or more hydrocarbon components having from 2 to 6 or more carbon atoms per molecule. In one embodiment, "natural gas liquids" or "NGL" can comprise less than 25, less than 15, less than 10, or less than 5 mole percent of methane and lighter components. NGL recovery facility 10 can be operable to remove or recover a substantial portion of the total amount of natural gas liquids in the incoming gas stream by cooling the gas with a single, closed-loop refrigeration cycle 12 and separating the resulting condensed liquids in a NGL fractionation zone 14. Additional details regarding the configuration and operation of NGL recovery facility 10, according to various embodiments of the present invention, will now be described with respect to the FIGURE.

As shown in FIG. 1, a hydrocarbon-containing feed gas stream can initially be introduced into NGL recovery facility 10 via conduit 110. The feed gas stream in conduit 110 can be any suitable hydrocarbon-containing fluid stream, such as, for example, a natural gas stream, a synthesis gas stream, a cracked gas stream, or combinations thereof. The feed gas stream in conduit 110 can originate from a variety of gas sources (not shown), including, but not limited to, a petroleum production well; a refinery processing unit, such as a fluidized catalytic cracker (FCC) or petroleum coker; or a heavy oil processing unit, such as an oil sands upgrader. In one embodiment, the feed stream in conduit 110 can be or comprise a cracked gas stream originating from an FCC, a coker, or an upgrader, while, in another embodiment, the feed gas stream in conduit 110 can be or comprise a natural gas stream originating from a production well penetrating a hydrocarbon-containing subterranean formation (not shown).

In one embodiment of the present invention, the hydrocarbon-containing feed gas stream in conduit 110 includes some amount of $C_2$ and heavier components. As used herein, the general term "$C_x$" refers to a hydrocarbon component comprising x carbon atoms per molecule and, unless otherwise noted, is intended to include all paraffinic and olefinic isomers thereof. Thus, "$C_2$" is intended to encompass both ethane and ethylene, while "$C_5$" is intended to encompass isopentane, normal pentane and all $C_5$ branched isomers, as well as $C_5$ olefins. As used herein, the term "$C_x$ and heavier" refers to hydrocarbons having x or more carbon atoms per molecule (including paraffinic and olefinic isomers), while the term "$C_x$ and lighter" refers to hydrocarbons having x or less carbon atoms per molecule (including paraffinic and olefinic isomers).

According to one embodiment, the feed gas stream in conduit 110 can comprise at least 5, at least 15, at least 25, at least 40, at least 50, or at least 65 mole percent $C_2$ and heavier components, based on the total moles of the feed gas stream. In the same or other embodiments, the feed gas stream in conduit 110 can comprise at least 5, at least 15, at least 20, at least 25, at least 30, or at least 50 mole percent $C_3$ and heavier components, based on the total moles of the feed gas stream. Typically, lighter components such as methane, nitrogen, and trace amounts of gases like hydrogen and carbon dioxide, make up the balance of the composition of the feed gas stream. In one embodiment, the feed gas stream in conduit 110 comprises less than 95, less than 80, less than 60, less than 50, less than 40, less than 30, or less than 25 mole percent of methane and lighter components, based on the total moles of the feed gas stream.

As shown in FIG. 1, the feed gas stream in conduit 110 may initially be routed to a pretreatment zone 18, wherein one or more undesirable constituents may be removed from the gas prior to cooling. In one embodiment, pretreatment zone 18 can include one or more vapor-liquid separation vessels (not shown) for removing liquid water or hydrocarbon components from the feed gas. Optionally, pretreatment zone 18 can include one or more acid gas removal zones (not shown), such as, for example, an amine unit, for removing carbon dioxide or sulfur-containing compounds from the gas stream in conduit 110.

The treated gas stream exiting pretreatment zone 18 via conduit 112 can then be routed to a dehydration unit 20, wherein substantially all of the residual water can be removed from the feed gas stream. Dehydration unit 20 can utilize any known water removal system, such as, for example, beds of molecular sieve. Once dried, the gas stream in conduit 116 can have a temperature of at least 45° F., at least 50° F., at least 60° F., at least 65° F., or at least 70° F. and/or less than 150° F., less than 135° F., or less than 110° F. and a pressure of at least 450, at least 600, at least 700, at least 850 and/or less than 1200, less than 1100, less than 1000, or less than 950 psia.

As shown in FIG. 1, the hydrocarbon-containing feed stream in conduit 116 can be introduced into a first cooling pass 26 of a primary heat exchanger 24. Primary heat exchanger 24 can be any heat exchanger or series of heat exchangers operable to cool and at least partially condense the feed gas stream in conduit 116 via indirect heat exchange with one or more cooling streams. In one embodiment, primary heat exchanger 24 can be a brazed aluminum heat exchanger comprising a plurality of cooling and warming passes (e.g., cores) disposed therein for facilitating indirect heat exchange between one or more process streams and one or more refrigerant streams. Although generally illustrated in FIG. 1 as comprising a single core or "shell," it should be understood that primary heat exchanger 24 can, in some embodiments, comprise two or more separate core or shells, optionally encompassed by a "cold box" to minimize heat gain from the surrounding environment.

The hydrocarbon-containing feed gas stream passing through cooling pass 26 of primary heat exchanger 24 can be cooled and at least partially condensed via indirect heat exchange with yet-to-be-discussed refrigerant and/or residue gas streams in respective passes 84 and 48. During cooling, a substantial portion of the $C_2$ and heavier and/or the $C_3$ and heavier components in the feed gas stream can be condensed out of the vapor phase to thereby provide a cooled, two-phase gas stream in conduit 118. In one embodiment, at least 50, at least 60, at least 70, at least 75, at least 80, or at least 85 mole percent of the total amount of $C_2$ and heavier components introduced into primary exchanger 24 via conduit 116 can be condensed within cooling pass 26, while, in the same or other embodiments, at least 50, at least 60, at least 70, at least 80, at least 90, or at least 95 mole percent of the total amount of $C_3$ and heavier components introduced into cooling pass 26 can be condensed therein.

According to one embodiment, the vapor phase of the two-phase stream in conduit 118 withdrawn from cooling pass 26 can comprise at least 50, at least 60, at least 75, at least 85, or at least 90 percent of the total amount of $C_1$ and lighter components originally introduced into primary heat exchanger 24 via conduit 116. The cooled feed gas stream in conduit 118 can have a temperature of no less than −165° F., no less than −160° F., no less than −150° F., no less than −140° F., no less than −130° F., no less than −120° F., no less than −100° F., or no less than −80° F. and/or a pressure of at least 450, at least 650, at least 750, at least 850 and/or less than 1200, less than 1100, or less than 950 psia.

As shown in FIG. 1, the cooled, preferably two-phase stream in conduit 118 can be introduced into a separation vessel 30, wherein the vapor and liquid portions of the feed gas stream can be separated into a predominantly vapor stream exiting separation vessel 30 via an upper vapor outlet 52 and a predominantly liquid stream exiting separation vessel 30 via a lower liquid outlet 54. As used herein, the terms "predominantly," "primarily," and "majority" mean greater than 50 percent. Separation vessel 30 can be any suitable vapor-liquid separation vessel and can have any number of actual or theoretical separation stages. In one embodiment, separation vessel 30 can comprise a single separation stage, while in other embodiments, separation vessel 30 can include at least 2, at least 4, at least 6, and/or less than 30, less than 20, or less than 10 actual or theoretical separation stages. When separation vessel 30 is a multistage separation vessel, any suitable type of column internals, such as mist eliminators, mesh pads, vapor-liquid contacting trays, random packing, and/or structured packing, can be used to facilitate heat and/or mass transfer between the vapor and liquid streams. In some embodiments, when separation vessel 30 is a single-stage separation vessel, few or no column internals can be employed.

According to one embodiment, separation vessel 30 can be operable to separate the majority of the methane and lighter components from the incoming feed gas stream, such that the overhead vapor stream exiting separation vessel 30 via conduit 120 can be enriched in methane and lighter components. For example, in one embodiment, the overhead vapor stream in conduit 120 can comprise at least 50, at least 60, at least 75, or at least 85 mole percent of methane and lighter components, which can include, for example, methane, carbon dioxide, carbon monoxide, hydrogen and/or nitrogen. According to one embodiment, the vapor stream in conduit 120 can comprise at least 55, at least 75, at least 80, at least 85, at least 90, or at least 95 percent of the total amount of $C_1$ and lighter components introduced into primary heat exchanger 24 via conduit 116.

The liquid portion of the cooled feed gas stream, which can be enriched in $C_2$ and heavier components, can be withdrawn from a liquid outlet 54 of separation vessel 30 via conduit 126. As shown in FIG. 1, the entire liquid stream in conduit 126 can then be passed through an expansion device 38, wherein the pressure of the liquid can be reduced to thereby flash or vaporize at least a portion thereof. Expansion device 38 can be any suitable expansion device, such as, for example, a Joule-Thompson valve or orifice or a hydraulic turbine. Although illustrated in FIG. 1 as comprising a single device 38, it should be understood that any suitable number of expansion devices can be employed. In one embodiment, the expansion can be a substantially isenthalpic expansion. As used herein, the term "substantially isenthalpic" refers to an expansion or flashing step carried out such that less than 1 percent of the total work generated during the expansion is transferred from the fluid to the surrounding environment. This is in contrast to an "isentropic" expansion, in which a majority or substantially all of the work generated during the expansion is transferred to the surrounding environment.

In one embodiment, as the result of the expansion, the temperature of the flashed or expanded fluid stream in conduit 128 can be at least 5° F., at least 10° F., or at least 15° F. and/or less than 75° F., less than 50° F., or less than 35° F. lower than the temperature of the stream in conduit 126. In the same or other embodiments, the pressure of the expanded stream in conduit 128 can be at least 150 psi, at least 300 psi, or at least 350 psi and/or less than 750 psi, less than 650 psi, or less than 500 psi lower than the pressure of the stream in conduit 126. The resulting expanded fluid stream in conduit 128 can have a temperature warmer than −150° F., warmer than −140° F., or warmer than −135° F. and/or cooler than −75° F., cooler than −80° F., or cooler than −85° F. In the same or other embodiments, the stream in conduit 128 can have a pressure of at least 250, at least 300, at least 350 psia and/or less than 750, less than 650, or less than 500 psia with a vapor fraction of at least 0.10, at least 0.15, at least 0.20, at least 0.25, or at least 0.30.

As shown in FIG. 1, the entire expanded two-phase stream in conduit 128 can be introduced into a first fluid inlet 42 of a distillation column 40. As used herein, the terms "first," "second," "third," and the like are used to describe various elements and such elements should not be limited by these terms. These terms are only used to distinguish one element from another and do not necessarily imply a specific order or even a specific element. For example, an element may be regarded as a "first" element in the description and a "second element" in the claims without departing from the scope of the present invention. Consistency is maintained within the description and each independent claim, but such nomenclature is not necessarily intended to be consistent therebetween.

Distillation column 40 can be any vapor-liquid separation vessel capable of further separating $C_2$ and heavier or $C_3$ and heavier components from the remaining $C_1$ and lighter or $C_2$ and lighter components. In one embodiment, distillation column 40 can be a multi-stage distillation column comprising at least 2, at least 8, at least 10, at least 12 and/or less than 50, less than 35, or less than 25 actual or theoretical separation stages. When distillation column 40 comprises a multi-stage column, one or more types of column internals may be utilized in order to facilitate heat and/or mass transfer between the vapor and liquid phases. Examples of suitable column internals can include, but are not limited to, vapor-liquid contacting trays, structured packing, random packing, and any combination thereof.

According to one embodiment, distillation column 40 can be operable to separate at least 65, at least 75, at least 85, at least 90, or at least 99 percent of the remaining $C_2$ and heavier and/or $C_3$ and heavier components from the fluid streams introduced thereto. According to one embodiment, the overhead (top) pressure of distillation column 40 can be at least 200, at least 300, or at least 400 and/or less than 800, less than 700, or less than 600 psia. In some embodiments, distillation column 40 can be operated at a substantially lower overhead pressure than separation vessel 30, which may be operated at a top pressure of at least 450, at least 600, or at least 700 psia and/or less than 1200, less than 1000, or less than 900 psia. Additional information regarding the operation of distillation column 40 will be discussed in detail shortly.

According to one embodiment shown in FIG. 1, at least a portion of the vapor stream withdrawn from separation vessel 30 via conduit 120 can be routed to a cooling pass 32 disposed within primary heat exchanger 24, wherein the vapor stream can be cooled and at least partially condensed via indirect heat exchange with yet-to-be-discussed refrigerant and/or residue gas streams in respective passes 84 and 48. The temperature of the cooled fluid stream exiting primary heat exchanger 24 via conduit 122 can be at least −175° F., at least −165° F., or at least −135° F. and/or less than −70° F., less than −100° F., or less than −110° F. As shown in FIG. 1, the cooled stream in conduit 122 can then be expanded via expansion device 34 to thereby provide a flashed or expanded fluid stream in conduit 124. In one embodiment, the expansion can be a substantially isenthalpic expansion, and expansion device 34 can be a JT expansion device, such as, for example, a JT valve or orifice. In another embodiment, the expansion 34 may be substantially isentropic and expansion device 34 may be a turboexpander or expansion turbine. In yet another embodiment (not shown in FIG. 1), an optional separator can be utilized to separate the cooled vapor stream in conduit 122 into a vapor and a liquid portion and the vapor and/or liquid portions withdrawn from the separator may be expanded with a respective turboexpander and hydraulic turbine or one or more JT devices.

Referring back to the stream in conduit 122, during its expansion, the cooled vapor stream can undergo similar changes in temperature and/or pressure as previously described with respect to the fluid streams in conduits 126 and 128. In one embodiment, as the result of the expansion, the temperature of the flashed or expanded fluid stream in conduit 124 can be at least 5° F., at least 10° F., or at least 15° F. and/or less than 75° F., less than 50° F., or less than 35° F. lower than the temperature of the stream in conduit 122. In the same or another embodiment, the pressure of the expanded stream in conduit 124 can be at least 150 psi, at least 300 psi, or at least 350 psi and/or less than 750 psi, less than 650 psi, or less than 500 psi lower than the pressure of the stream in conduit 122. In some embodiments, the expanded stream in conduit 124 can be a two-phase stream having, for example, a vapor fraction of at least 0.05, at least 0.15, at least 0.20, at least 0.25, or at least 0.30.

As shown in FIG. 1, the two-phase expanded vapor stream in conduit 124 can then be introduced into a second fluid inlet 36 of distillation column 40. In one embodiment, second fluid inlet 36 can be positioned at a higher separation stage than first fluid inlet 42. As used herein, the terms "higher separation stage" and "lower separation stage" refer to actual, theoretical, or actual or theoretical heat and/or mass transfer stages vertically spaced within a distillation column. In one embodiment, second fluid inlet 36 can be positioned in the upper one-half, upper one-third, or upper one-fourth of the total number of separation stages within distillation column 40, while first fluid inlet 42 can be positioned in the lower one-half, the lower two-thirds, or the middle or lower one-third or one-fourth of the total number of separation stages within distillation column 40. According to one embodiment, first and second fluid inlets 42, 36 can be vertically spaced from one another by at least 1, at least 4, at least 8, at least 10, or at least 12 actual, theoretical, or actual or theoretical heat and/or mass transfer stages of distillation column 40.

According to some embodiments, the center point of first fluid inlet 42 can be positioned at a lower vertical elevation along distillation column 40 than the center point of second fluid inlet 36. For example, in one embodiment, second fluid inlet 36 can be positioned within the upper one-half, upper one-third, or upper one-fourth of the total vertical elevation of distillation column 40, while first fluid inlet 42 can be positioned in the lower one-half, the lower two-thirds, or the middle or lower one-third or one-fourth of the total vertical elevation of distillation column 40. The total vertical elevation of distillation column 40 can be measured in any suitable manner, such as, for example, as a tangent-to-tangent length or height (T/T) or end-to-end length or height.

According to one embodiment of the present invention, NGL recovery facility 10 may employ an optional vapor bypass stream, which is split from the overhead vapor stream in conduit 120 prior to cooling. The vapor bypass stream may be employed, in some embodiments, in order to compensate for changes in feed gas composition. For example, in one embodiment, when the feed gas stream in conduits 116 and/or 118 comprises at least 75, at least 85, or at least 95 mole percent of methane and lighter components, at least a portion of the overhead vapor stream exiting separator 30 may be bypassed around primary exchanger 24, as depicted by dashed conduit 130. Thereafter, the portion of the vapor stream in conduit 130 can be passed through an expansion device 44, wherein the stream can be flashed or expanded. In one embodiment, the expansion can be substantially isenthalpic and expansion device 44 can be a JT device, such as a valve or orifice. In another embodiment, the expansion can be substantially isentropic and expansion device 44 can be any device capable of transferring a majority of the work generated during the expansion to the surrounding environment, such as a turboexpander or expansion turbine. The change in pressure and/or temperature of the resulting expanded fluid stream in conduit 132 can be similar to those discussed previously with respect to the expanded streams in conduits 128 and/or 124. The vapor fraction of the stream in conduit 132 can be at least 0.50, at least 0.65, at least 0.80, or at least 0.90.

As illustrated in FIG. 1, the expanded two-phase fluid stream in conduit 132 can then be introduced into a third fluid inlet 46 of distillation column 40. Third fluid inlet 46 can be located at a lower separation stage than second fluid inlet 36 and, in some embodiments, can be located at substantially the same separation stage as or at a lower separation stage than first fluid inlet 42. In one embodiment, first and third fluid inlets 42, 46 can be separated by less than 5, less than 3, less than 2, or 1 actual or theoretical mass transfer stage, while, in another embodiment, first and third fluid inlets 42, 46 can be located in the same actual or theoretical mass transfer stage of distillation column 40.

As shown in FIG. 1, the overhead vapor stream withdrawn from vapor outlet 56 of distillation column 40 can be routed via conduit 138 to a warming pass 48 of primary heat exchanger 24, wherein the stream can be warmed via indirect heat exchange with a yet-to-be-discussed refrigerant stream in cooling pass 80 and/or at least one of the streams in cooling passes 26 and/or 32. The resulting warmed vapor stream in conduit 140 can optionally be compressed via residue gas compressor 50 before being routed out of NGL recovery facility 10 via conduit 142. Typically, the residue gas stream in conduit 142 can have a pressure of at least 500, at least 750, at least 1,000 psia and/or less than 1750, less than 1500, or less than 1300 psia. In one embodiment, the residue gas stream can comprise at least 35, at least 50, at least 65, at least 70, or at least 75 percent of the total amount of $C_1$ and lighter components introduced into separation vessel 30 via conduit 118 and can have a vapor fraction of at least 0.85, at least 0.90, at least 0.95, or can be substantially all vapor. Once removed from NGL recovery facility 10, the compressed gas stream in conduit 142 can be routed to further use, processing, and/or storage. In one embodiment, at least a portion of the stream can be routed to a natural gas pipeline for transmission to downstream users.

As shown in FIG. 1, distillation column 40 can optionally include at least one reboiler 59 for heating and at least partially vaporizing a liquid stream withdrawn from distillation column 40 via conduit 144. Reboiler 59 can heat the liquid stream in conduit 144 via indirect heat exchange with a warming fluid stream, such as, for example, steam, heat transfer medium, or the like introduced into reboiler 59 via conduit 158*a*. In one embodiment, the warming stream in conduit 158*a* comprises at least a portion of the feed gas stream withdrawn from or within conduits 110, 112, and/or 116. In another embodiment, the warming stream in conduit 158*a* can comprise a portion of the feed gas stream routed from conduit 116 to bypass cooling pass 26 of primary heat exchanger 24. In this embodiment, the cooled stream exiting reboiler 59 via conduit 158*b* could then be recombined with the cooled feed gas exiting cooling pass 26 in conduit 118 (embodiment not shown in FIG. 1). Although generally illustrated as including a single reboiler 59, it should be understood that any suitable number of reboilers, operable to withdraw streams at the same or different mass transfer stages within distillation column 40, can be employed in order to maintain the desired temperature and/or composition profile therein.

According to one embodiment of the present invention, the liquid product stream withdrawn from lower liquid outlet 58 of distillation column 40 via conduit 136 can be enriched in $C_2$ and heavier or $C_3$ and heavier components. In the same or other embodiments, the NGL product stream recovered in conduit 136 can comprise at least 75, at least 80, at least 85, at least 90, or at least 95 mole percent of $C_2$ and heavier or $C_3$ and heavier components. Correspondingly, the NGL product stream can comprise less than 25, less than 20, less than 15, less than 10, or less than 5 mole percent of $C_1$ and lighter or $C_2$ and lighter components, depending on the operation of NGL recovery facility 10. Further, in one embodiment, the NGL product stream in conduit 136 can comprise at least 50, at least 65, at least 75, at least 85, at least 90, at least 95, at least 97, or at least 99 percent of all the $C_2$ and heavier or $C_3$ and heavier components originally introduced into primary exchanger 24 via conduit 116. That is, in some embodiments, processes and systems of the present invention can have a $C_2$+ or $C_3$+ recovery of at least 50, at least 65, at least 75, at least 85, at least 90, at least 95, at least 97, or at least 99 percent. In one embodiment, the NGL product stream in conduit 136 can subsequently be routed to a fractionation zone (not shown) comprising one or more additional separation vessels or columns, wherein individual product streams enriched in, for example, $C_2$, $C_3$, and/or $C_4$ and heavier components can be produced for subsequent use, storage, and/or further processing.

Turning now to refrigeration cycle 12 of NGL recovery facility 10 depicted in FIG. 1, closed-loop refrigeration cycle 12 is illustrated as generally comprising a refrigerant compressor 60, an optional interstage cooler 62 and interstage accumulator 64, a refrigerant condenser 66, a refrigerant accumulator 68, and a refrigerant suction drum 70. As shown in FIG. 1, a mixed refrigerant stream withdrawn from suction drum 70 via conduit 170 can be routed to a suction inlet of refrigerant compressor 60, wherein the pressure of the refrigerant stream can be increased. When refrigerant compressor 60 comprises a multistage compressor having two or more compression stages, as shown in FIG. 1, a partially compressed refrigerant stream exiting the first (low pressure) stage of compressor 60 can be routed via conduit 172 to interstage cooler 62, wherein the stream can be cooled and at least partially condensed via indirect heat exchange with a cooling medium (e.g., cooling water or air).

The resulting two-phase refrigerant stream in conduit 174 can then be introduced into interstage accumulator 64, wherein the vapor and liquid portions can be separated. A vapor stream withdrawn from accumulator 64 via conduit 176 can be routed to the inlet of the second (high pressure) stage of refrigerant compressor 60, wherein the stream can be further compressed. The resulting compressed refrigerant vapor stream, which can have a pressure of at least 100, at least 150, or at least 200 psia and/or less than 550, less than 500, less than 450, or less than 400 psia, can be recombined with a portion of the liquid phase refrigerant withdrawn from interstage accumulator 64 via conduit 178 and pumped to pressure via refrigerant pump 74 in conduit 180, as shown in FIG. 1.

The combined refrigerant stream in conduit 180 can then be routed to refrigerant condenser 66, wherein the pressurized refrigerant stream can be cooled and at least partially condensed via indirect heat exchange with a cooling medium (e.g., cooling water) before being introduced into refrigerant accumulator 68 via conduit 182. As shown in FIG. 1, the vapor and liquid portions of the two-phase refrigerant stream in conduit 182 can be separately withdrawn from refrigerant accumulator 68 via respective vapor and liquid conduits 184 and 186. Optionally, a portion of the liquid stream in conduit 186, pressurized via refrigerant pump 76, can be combined with the vapor stream in conduit 184 just prior to or within a refrigerant cooling pass 80 disposed within primary exchanger 24, as shown in FIG. 1. In some embodiments, re-combining a portion of the vapor and liquid portions of the compressed refrigerant in this manner may help ensure proper fluid distribution within refrigerant cooling pass 80.

As the compressed refrigerant stream flows through refrigerant cooling pass 80, the stream is condensed and sub-cooled, such that the temperature of the liquid refrigerant stream withdrawn from primary heat exchanger 224 via conduit 188 is well below the bubble point of the refrigerant mixture. The sub-cooled refrigerant stream in conduit 188 can then be expanded via passage through a refrigerant expansion device 82 (illustrated herein as a Joule-Thompson valve), wherein the pressure of the stream can be reduced, thereby cooling and at least partially vaporizing the refrigerant stream and generating refrigeration. The cooled, two-phase refrigerant stream in conduit 190 can then be routed through a refrigerant warming pass 84, wherein a substantial portion of the refrigeration generated can be used to cool one or more process streams, including at least one of the feed stream in cooling pass 26, the vapor stream in cooling pass 32, and the refrigerant stream in cooling pass 80. The warmed refrigerant stream withdrawn from primary heat exchanger 24 via conduit 192 can then be routed to refrigerant suction drum 70 before being compressed and recycled through closed-loop refrigeration cycle 12 as previously discussed.

According to one embodiment of the present invention, during each step of the above-discussed refrigeration cycle, the temperature of the refrigerant can be maintained such that at least a portion, or a substantial portion, of the $C_2$ and heavier components or the $C_3$ and heavier components originally present in the feed gas stream can be condensed in primary exchanger 24. For example, in one embodiment, at least 50, at least 65, at least 75, at least 80, at least 85, at least 90, or at least 95 percent of the total $C_2$+ components or at least 50, at least 65, at least 75, at least 80, at least 85, at least 90, or at least 95 percent of the total $C_3$+ components originally present in the feed gas stream introduced into primary exchanger 24 can be condensed. In the same or another embodiment, the minimum temperature achieved by the refrigerant during each step of the above-discussed refrigeration cycle can be no less than −175° F., no less than −170° F., no less than −165° F., no less than −160° F., no less than −150°, no less than −145° F., no less than −140° F., or no less than −135° F.

In one embodiment, the refrigerant utilized in closed-loop refrigeration cycle 12 can be a mixed refrigerant. As used herein, the term "mixed refrigerant" refers to a refrigerant composition comprising two or more constituents. In one embodiment, the mixed refrigerant utilized by refrigeration cycle 12 can comprise two or more constituents selected from the group consisting of methane, ethylene, ethane, propylene, propane, isobutane, n-butane, isopentane, n-pentane, and combinations thereof. In some embodiments, the refrigerant composition can comprise methane, ethane, propane, normal butane, and isopentane and can substantially exclude certain components, including, for example, nitrogen or halogenated hydrocarbons. According to one embodiment, the refrigerant composition can have an initial boiling point of at least −135° F., at least −130° F., or at least −120° F. and/or less than −100° F., less than −105° F., or less than −110° F. Various specific refrigerant compositions are contemplated according to embodiments of the present invention. Table 1, below, summarizes broad, intermediate, and narrow ranges for several exemplary refrigerant mixtures.

TABLE 1

Exemplary Mixed Refrigerant Compositions

| Component | Broad Range, mole % | Intermediate Range, mole % | Narrow Range, mole % |
|---|---|---|---|
| methane | 0 to 50 | 5 to 40 | 5 to 20 |
| ethylene | 0 to 50 | 5 to 40 | 20 to 40 |
| ethane | 0 to 50 | 5 to 40 | 20 to 40 |
| propylene | 0 to 50 | 5 to 40 | 20 to 40 |
| propane | 0 to 50 | 5 to 40 | 20 to 40 |
| i-butane | 0 to 10 | 0 to 5 | 0 to 2 |
| n-butane | 0 to 25 | 1 to 20 | 0 to 15 |
| i-pentane | 0 to 30 | 1 to 20 | 10 to 20 |
| n-pentane | 0 to 10 | 0 to 5 | 0 to 2 |

In some embodiments of the present invention, it may be desirable to adjust the composition of the mixed refrigerant to thereby alter its cooling curve and, therefore, its refrigeration potential. Such a modification may be utilized to accommodate, for example, changes in composition and/or flow rate of the feed gas stream introduced into NGL recovery facility 10. In one embodiment, the composition of the mixed refrigerant can be adjusted such that the heating curve of the vaporizing refrigerant more closely matches the cooling curve of the feed gas stream. One method for such curve matching is described in detail, with respect to an LNG facility, in U.S. Pat. No. 4,033,735, incorporated herein by reference to the extent not inconsistent with the present disclosure.

According to one embodiment of the present invention, such a modification of the refrigeration composition may be desirable in order to alter the proportion or amount of specific components recovered in the NGL product stream. For example, in one embodiment, it may be desirable to recover $C_2$ components in the NGL product stream (e.g., $C_2$ recovery mode), while, in another embodiment, rejecting $C_2$ components in the overhead residue gas withdrawn from distillation column 40 may be preferred (e.g., $C_2$ rejection mode). In addition to altering the composition of the mixed refrigerant, the transition between a $C_2$ recovery mode and a $C_2$ rejection mode may be affected by, for example, altering the operation of separation vessel 30 and/or distillation column 40. For example, in one embodiment, the temperature and/or pressure of distillation column 40 can be adjusted to vaporize more or less $C_2$ components, thereby selectively operating distillation column 40 in a $C_2$ rejection or $C_2$ recovery mode.

When operating distillation column 40 in a $C_2$ recovery mode, the NGL product stream in conduit 136 can comprise at least 50, at least 65, at least 75, at least 85, or at least 90 percent of the total $C_2$ components introduced into primary heat exchanger 24 via conduit 116 and/or the residue gas stream in conduit 138 can comprise less than 50, less than 35, less than 25, less than 15, or less than 10 percent of the total $C_2$ components introduced into primary heat exchanger 24 via conduit 116. When operating distillation column 40 in a $C_2$ rejection mode, the NGL product stream in conduit 136 can comprise less than 50, less than 40, less than 30, less than 20, less than 15, less than 10, or less than 5 percent of the total amount of $C_2$ components introduced into primary heat exchanger 24 via conduit 116 and/or the residue gas stream in conduit 138 can comprise at least 50, at least 60, at least 70, at least 80, at least 85, at least 90, or at least 95 percent of the total amount of $C_2$ components introduced into primary heat exchanger 24 via conduit 116.

The preferred forms of the invention described above are to be used as illustration only, and should not be used in a limiting sense to interpret the scope of the present invention. Obvious modifications to the exemplary one embodiment, set forth above, could be readily made by those skilled in the art without departing from the spirit of the present invention. The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A process for recovering natural gas liquids (NGL) from a hydrocarbon-containing feed gas stream, said process comprising:

(a) cooling and at least partially condensing a hydrocarbon-containing feed gas stream to thereby provide a cooled feed gas stream, wherein at least a portion of said cooling is carried out via indirect heat exchange with a mixed refrigerant stream in a first heat exchanger of a closed-loop mixed refrigerant refrigeration cycle;

(b) separating said cooled feed gas stream into a first vapor stream and a first liquid stream in a vapor-liquid separator;

(c) splitting said first vapor stream into a first vapor portion and a second vapor portion;

(d) cooling at least a portion of said first vapor portion in said first heat exchanger to thereby provide a cooled first vapor stream, wherein at least a portion of said cooling is carried out via indirect heat exchange with said mixed refrigerant stream used to perform said cooling of step (a);

(e) flashing said cooled first vapor stream to thereby provide a first flashed stream;

(f) flashing said second vapor portion to thereby provide a second flashed stream;

(g) flashing the entire first liquid stream to provide a two-phase fluid stream having a vapor fraction of at least 0.10;

(h) introducing said first flashed stream, the entire two-phase fluid stream, and said second flashed stream into a distillation column via respective first, second, and third fluid inlets of said distillation column, wherein said first fluid inlet is located at a higher separation stage than said second and said third fluid inlets, and wherein said third fluid inlet is located at the same separation stage or at a lower separation stage than said second fluid inlet; and (i) recovering an overhead residue gas stream and a liquid bottoms product stream from said distillation column, wherein said recovering step includes operating said distillation column in a $C_2$ recovery mode or a $C_2$ rejection mode, wherein, when said distillation column is operated in said $C_2$ recovery mode, said liquid bottoms product stream comprises at least 90 percent of the total moles of $C_2$ components in said hydrocarbon-containing feed gas stream introduced into said first heat exchanger and said overhead residue gas stream comprises less than 10 percent of the total moles of $C_2$ components in said hydrocarbon-containing feed gas stream introduced into said first heat exchanger, and wherein, when said distillation column is operated in a $C_2$ rejection mode, said liquid bottoms product stream comprises less than 30 percent of the total moles of $C_2$ components in said hydrocarbon-containing feed gas stream introduced into said first heat exchanger and said overhead residue gas stream comprises at least 70 percent of the total moles of $C_2$ components in said hydrocarbon containing feed gas stream introduced into said first heat exchanger, wherein prior to step (a), said mixed refrigerant stream is compressed, cooled, and expanded to thereby generate refrigeration, wherein at least a portion of said refrigeration is used to accomplish at least a portion of said cooling of step (a) and at least a portion of said cooling of step (d).

2. The process of claim 1, wherein at least a portion of said cooling of step (d) is carried out via indirect heat exchange with said overhead residue gas stream recovered from said distillation column.

3. The process of claim 1, wherein the temperature of said cooled first vapor stream is reduced by less than 75° F. during said flashing of step (e).

4. The process of claim 1, wherein said distillation column includes a total number of separation stages and wherein said third fluid inlet is located in the lower two-thirds of the total number of separation stages of said distillation column.

5. The process of claim 1, wherein said mixed refrigerant stream comprises two or more components selected from the group consisting of methane, ethylene, ethane, propylene, propane, isobutane, normal butane, isopentane, and normal pentane.

6. The process of claim 1, wherein said recovering step includes operating said distillation column in said $C_2$ rejection mode wherein said liquid bottoms product stream comprises less than 10 percent of the total moles of $C_2$ components in said hydrocarbon-containing feed gas stream introduced into said first heat exchanger.

7. A process for recovering natural gas liquids (NGL) from a hydrocarbon-containing feed gas stream, said process comprising:

(a) cooling a hydrocarbon-containing feed gas stream in a first heat exchanger via indirect heat exchange with a mixed refrigerant stream to thereby provide a cooled feed gas stream and a warmed refrigerant stream;

(b) separating said cooled feed gas stream into a first vapor stream and a first liquid stream in a vapor-liquid separator;

(c) splitting said first vapor stream into a first vapor portion and a second vapor portion;

(d) cooling said first vapor portion to thereby provide a cooled vapor portion, wherein at least a portion of said cooling is carried out in said first heat exchanger via indirect heat exchange with said mixed refrigerant stream used to perform said cooling of step (a);

(e) flashing said cooled vapor portion to thereby provide a first flashed stream;

(f) flashing said second vapor portion to thereby provide a second flashed stream;

(g) introducing said first and said second flashed streams into a distillation column at respective first and second fluid inlets;

(h) flashing the entire first liquid stream to thereby provide a third flashed stream and introducing the entire third flashed stream into said distillation column via a third fluid inlet, wherein said third flashed stream is a two-phase stream having a vapor fraction of at least 0.10; and (i) recovering an NGL-enriched liquid product stream and an overhead residue gas stream from said distillation column, wherein said recovering includes operating said distillation column in a $C_2$ recovery mode or a $C_2$ rejection mode, wherein said second fluid inlet is and said third fluid inlet are located at lower separation stages than said first fluid inlet, wherein said second fluid inlet is located at the same separation stage as or at a lower separation stage than said third fluid inlet, wherein, when said distillation column is operated in said $C_2$ recovery mode, said liquid product stream comprises at least 90 percent of the total moles of $C_2$ components in said hydrocarbon-containing feed gas stream introduced into said first heat exchanger and said overhead residue gas stream comprises less than 10 percent of the total moles of $C_2$ components in said hydrocarbon-containing feed gas stream introduced into said first heat exchanger, and wherein, when said distillation column is operated in a $C_2$ rejection mode, said liquid product stream comprises less than 30 percent of the total moles of $C_2$ components in said hydrocarbon-containing feed gas stream introduced into said first heat exchanger and said overhead residue gas stream comprises at least 70 percent of the total moles of $C_2$ components in said hydrocarbon containing feed gas stream introduced into said first heat exchanger.

8. The process of claim 7, wherein said distillation column has a total number of separation stages, and wherein said second fluid inlet is located in the lower two-thirds of the total number of separation stages of said distillation column.

9. The process of claim 7, wherein said mixed refrigerant stream comprises two or more components selected from the group consisting of methane, ethylene, ethane, propylene, propane, isobutane, normal butane, isopentane, and normal pentane.

10. The process of claim 7, wherein said mixed refrigerant stream is compressed, subcooled, and expanded prior to said cooling of step (a), wherein the minimum temperature of said mixed refrigerant stream during each of the compression, subcooling, and expansion steps is not less than 175° F.

11. A facility for recovering natural gas liquids (NGL) from a hydrocarbon-containing feed gas stream using a single closed-loop mixed refrigeration cycle, said facility comprising:

a primary heat exchanger having a first cooling pass disposed therein, wherein said first cooling pass is operable to cool said hydrocarbon-containing feed gas stream;

a vapor-liquid separator fluidly coupled to said first cooling pass for receiving the cooled feed gas stream, said vapor-liquid separator comprising a first vapor outlet for discharging a first vapor stream, and a first liquid outlet for discharging a first liquid stream;

a vapor splitter defining a single vapor inlet and two vapor outlets for splitting said first vapor stream into a first vapor portion and a second vapor portion, wherein said single vapor inlet is fluidly coupled to said vapor outlet of said vapor-liquid separator;

a second cooling pass disposed within said primary heat exchanger and fluidly coupled to one of said vapor outlets of said vapor splitter, wherein said second cooling pass is configured for cooling at least a portion of said first vapor portion;

a first expansion device fluidly coupled to said second cooling pass for flashing at least a portion of the cooled first vapor portion to provide a first flashed stream;

a second expansion device fluidly coupled to said first liquid outlet of said vapor-liquid separator for flashing the entire first liquid stream to provide a second flashed stream comprising two phases and having a vapor fraction of at least 0.10;

a third expansion device for flashing the second vapor portion to provide a third flashed stream, wherein the other of said vapor outlets of said splitter is fluidly coupled to said third expansion device;

a distillation column comprising a first fluid inlet for receiving said first flashed stream from said first expansion device, a second fluid inlet for receiving the entire second flashed stream from said second expansion device, a third fluid inlet for receiving said third flashed stream from said third expansion device, an upper vapor outlet for discharging an overhead residue gas stream, and a lower liquid outlet for discharging a liquid product stream, wherein said distillation column is configured to operate in a $C_2$ recovery mode or a $C_2$ rejection mode, wherein said first fluid inlet of said distillation column is positioned at a higher separation stage than said second fluid inlet and said third fluid inlet of said distillation column, wherein and said third fluid inlet is positioned at the same separation stage or at a lower separation stage than said second fluid inlet; and a single closed-loop mixed refrigeration cycle, said cycle comprising— a refrigerant compressor defining a suction inlet for receiving a mixed refrigerant stream and a discharge outlet for discharging a stream of compressed mixed refrigerant;

a first refrigerant cooling pass disposed within said primary heat exchanger, wherein said first refrigerant cooling pass is fluidly coupled to said discharge outlet of said refrigerant compressor and is configured to subcool the compressed mixed refrigerant stream;

a refrigerant expansion device fluidly coupled to said first refrigerant cooling pass for expanding the subcooled mixed refrigerant stream and generating refrigeration; and a first refrigerant warming pass disposed within said primary heat exchanger, wherein said first refrigerant warming pass fluidly coupled to said refrigerant expansion device, wherein said first refrigerant warming pass is configured to cool the feed gas stream in said first cooling pass and the vapor stream in said second cooling pass, wherein said first refrigerant warming pass is fluidly coupled to said suction inlet of said refrigerant compressor, wherein, when said distillation column is operated in said $C_2$ recovery mode, said liquid product stream comprises at least 90 percent of the total moles of $C_2$ components in said hydrocarbon-containing feed gas stream introduced into said first cooling pass of said primary heat exchanger and said overhead residue gas stream comprises less than 10 percent of the total moles of $C_2$ components in said hydrocarbon-containing feed gas stream introduced into said first cooling pass of said primary heat exchanger, and wherein, when said distillation column is operated in a $C_2$ rejection mode, said liquid product stream comprises less than 30 percent of the total moles of $C_2$ components in said hydrocarbon-containing feed gas stream introduced into said first cooling pass of said primary heat exchanger and said overhead residue gas stream comprises at least 70 percent of the total moles of $C_2$ components in said hydrocarbon containing feed gas stream introduced into said first cooling pass of said primary heat exchanger.

12. The facility of claim 11, wherein said distillation column has a total number of separation stages, wherein said first fluid inlet is located in the upper one-third of the total number of separation stages of said distillation column and said second and said third fluid inlets are located in the lower two-thirds of the total number of separation stages of said distillation column.

13. The process of claim 1, further comprising, warming said overhead residue gas stream recovered from said distillation column in said first heat exchanger via indirect heat exchange with at least one of said feed gas stream, said mixed refrigerant stream, and said first vapor stream.

14. The process of claim 7, further comprising recovering an overhead residue gas stream from said distillation column and warming said overhead residue gas stream via indirect heat exchange with at least one other stream in said first heat exchanger.

15. The facility of claim 11, wherein said distillation column further comprises an upper vapor outlet for discharging an overhead gas stream; and further comprising a residue gas warming pass disposed within said primary heat exchanger for heating the overhead residue gas stream withdrawn from said distillation column, wherein said residue gas warming pass is coupled in fluid flow communication with said upper vapor outlet of said distillation column.

16. The process of claim 1, wherein said third fluid inlet is located at the same separation stage as said second fluid inlet.

17. The process of claim 7, wherein said second fluid inlet is located at the same separation stage as said third fluid inlet.

18. The facility of claim 11, wherein said third fluid inlet is positioned at the same separation stage as said second fluid inlet.

* * * * *